US010544660B2

(12) United States Patent
Kuykendall

(10) Patent No.: US 10,544,660 B2
(45) Date of Patent: Jan. 28, 2020

(54) RECYCLE LOOP FOR A GAS LIFT PLUNGER

(71) Applicant: EPIC LIFT SYSTEMS LLC, Fort Worth, TX (US)

(72) Inventor: Schuyler Kuykendall, Granbury, TX (US)

(73) Assignee: EPIC LIFT SYSTEMS LLC, Fort Worth, TX (US)

( * ) Notice: Subject to any disclaimer, the term of this patent is extended or adjusted under 35 U.S.C. 154(b) by 453 days.

(21) Appl. No.: 15/377,429

(22) Filed: Dec. 13, 2016

(65) Prior Publication Data

US 2017/0183944 A1 Jun. 29, 2017

Related U.S. Application Data

(60) Provisional application No. 62/272,383, filed on Dec. 29, 2015.

(51) Int. Cl.
*E21B 43/12* (2006.01)
*E21B 47/09* (2012.01)

(52) U.S. Cl.
CPC ..... *E21B 43/122* (2013.01); *E21B 43/123* (2013.01); *E21B 47/09* (2013.01)

(58) Field of Classification Search
CPC .... E21B 43/121; E21B 43/122; E21B 43/123; E21B 43/12; E21B 47/00; E21B 47/09; E21B 47/12; F04B 47/12; Y10T 137/2524; Y10T 137/265; F16K 11/0836
See application file for complete search history.

(56) References Cited

U.S. PATENT DOCUMENTS

| | | | | |
|---|---|---|---|---|
| 1,993,292 | A | 3/1935 | Woods | |
| 3,090,316 | A | 5/1963 | Montgomery | |
| 3,548,939 | A * | 12/1970 | Bennett | E21B 43/122 166/267 |
| 4,211,279 | A * | 7/1980 | Isaacks | E21B 33/068 166/106 |
| 4,685,522 | A * | 8/1987 | Dixon | E21B 43/00 137/624.2 |
| 5,735,346 | A | 4/1998 | Brewer | |
| 5,875,858 | A * | 3/1999 | Brady | E21B 10/60 175/68 |
| 6,516,879 | B1 | 2/2003 | Hershberger | |
| 9,429,000 | B1 | 8/2016 | Velasquez | |
| 2002/0074118 | A1 | 6/2002 | Fisher | |
| 2003/0121656 | A1 | 7/2003 | Hershberger | |

(Continued)

OTHER PUBLICATIONS

Shuyler Kuykendall, "Recycle Loop Fora Gas Lift Plunger", U.S. Appl. No. 15/367,389, filed Dec. 2, 2016.

*Primary Examiner* — George S Gray
(74) *Attorney, Agent, or Firm* — MH2 Technology Law Group LLP

(57) ABSTRACT

A system and method for operating a gas lift plunger in a well. The method includes determining that the plunger is at a predetermined position in the well, well. The method also includes introducing gas from a compressor into a sales line in response to determining that the plunger is at the predetermined position in the well. The method also includes and introducing the gas from the compressor into the well at a predetermined amount of time after the plunger is determined to be at the predetermined position in the well.

20 Claims, 3 Drawing Sheets

(56) References Cited

U.S. PATENT DOCUMENTS

| | | | | |
|---|---|---|---|---|
| 2003/0145991 | A1* | 8/2003 | Olsen | E21B 37/00<br>166/265 |
| 2004/0244991 | A1 | 12/2004 | Reitz | |
| 2007/0039739 | A1 | 2/2007 | Wilson | |
| 2008/0185141 | A1 | 8/2008 | Amies | |

* cited by examiner

RECYCLE LOOP FOR A GAS LIFT PLUNGER

CROSS-REFERENCE TO RELATED APPLICATIONS

This application claims priority to U.S. Provisional Patent Application having Ser. No. 62/272,383, which was filed on Dec. 29, 2015 and is incorporated herein by reference in its entirety.

BACKGROUND

Gas lift plungers are employed to facilitate the removal of gas from wells, addressing challenges incurred by "liquid loading." In general, a well may produce both liquid and gaseous elements. When gas flow rates are high, the gas carries the liquid out of the well as the gas rises. However, as the pressure in the well decreases, the flowrate of the gas decreases to a point below which the gas fails to carry the heavier liquids to the surface. The liquids thus fall back to the bottom of the well, exerting back pressure on the formation, and thereby loading the well.

Plungers alleviate such loading by assisting in removing liquid and gas from the well, e.g., in situations where the ratio of liquid to gas is high. For example, the plunger is introduced into the top of the well. One type of plunger includes a bypass valve that is initially in an open position. When the bypass valve is in the open position, the plunger descends through a tubing string in the well toward the bottom of the well. Once the plunger reaches the bottom of the well, the bypass valve is closed. A compressed gas is then introduced into the well, below the plunger. The compressed gas lifts the plunger within the tubing string, causing any liquids above the plunger to be raised to the surface.

A compressor at the surface pressurizes the gas that is introduced into the well. As will be appreciated, the operation of the plunger is more efficient when the compressed gas is not introduced into the well as the plunger is descending. However, releasing the compressed gas into the atmosphere as the plunger descends generates a loud noise that may be harmful to the ears of those around. In addition, releasing the compressed gas into the atmosphere may also raise environmental concerns. Another option would be to turn the compressor off every time the plunger is descending; however, frequent switching of the compressor on and off may be inefficient and may reduce the lifespan of the compressor. What is needed is an improved system and method for redirecting the gas exiting the compressor as the plunger descends in the well.

SUMMARY

Embodiments of the disclosure may provide a method for operating a gas lift plunger in a well. The method includes determining that the plunger is at a predetermined position in the well, introducing gas from a compressor into a sales line in response to determining that the plunger is at the predetermined position in the well, and introducing the gas from the compressor into the well at a predetermined amount of time after the plunger is determined to be at the predetermined position in the well.

Embodiments of the disclosure may also provide a method for operating a gas lift plunger in a well. The method includes determining that the plunger is at a predetermined position in the well. The predetermined position is proximate to a top of the well. The method also includes introducing gas from a compressor into a sales line in response to determining that the plunger is at the predetermined position in the well. The method additionally includes introducing the gas from the compressor into the well at a predetermined amount of time after the plunger is determined to be at the predetermined position in the well. The predetermined amount of time is equal to or greater than an amount of time for the plunger to descend to an actuator at a bottom of the well. The gas introduced into the well is used to lift the plunger in the well, and a pressure of the gas introduced into the sales line is substantially the same as a pressure of the gas introduced into the well.

Embodiments of the disclosure may further provide a system for operating a gas lift plunger in a well. The system includes a sensor configured to determine that the plunger is at a predetermined position in the well, a compressor configured to output a gas, and a valve configured to direct the gas output from the compressor into a sales line in response to the sensor determining that the plunger is at the predetermined position in the well and to direct the gas output from the compressor into the well at a predetermined amount of time after the plunger is determined to be at the predetermined position in the well.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

Figure 1:
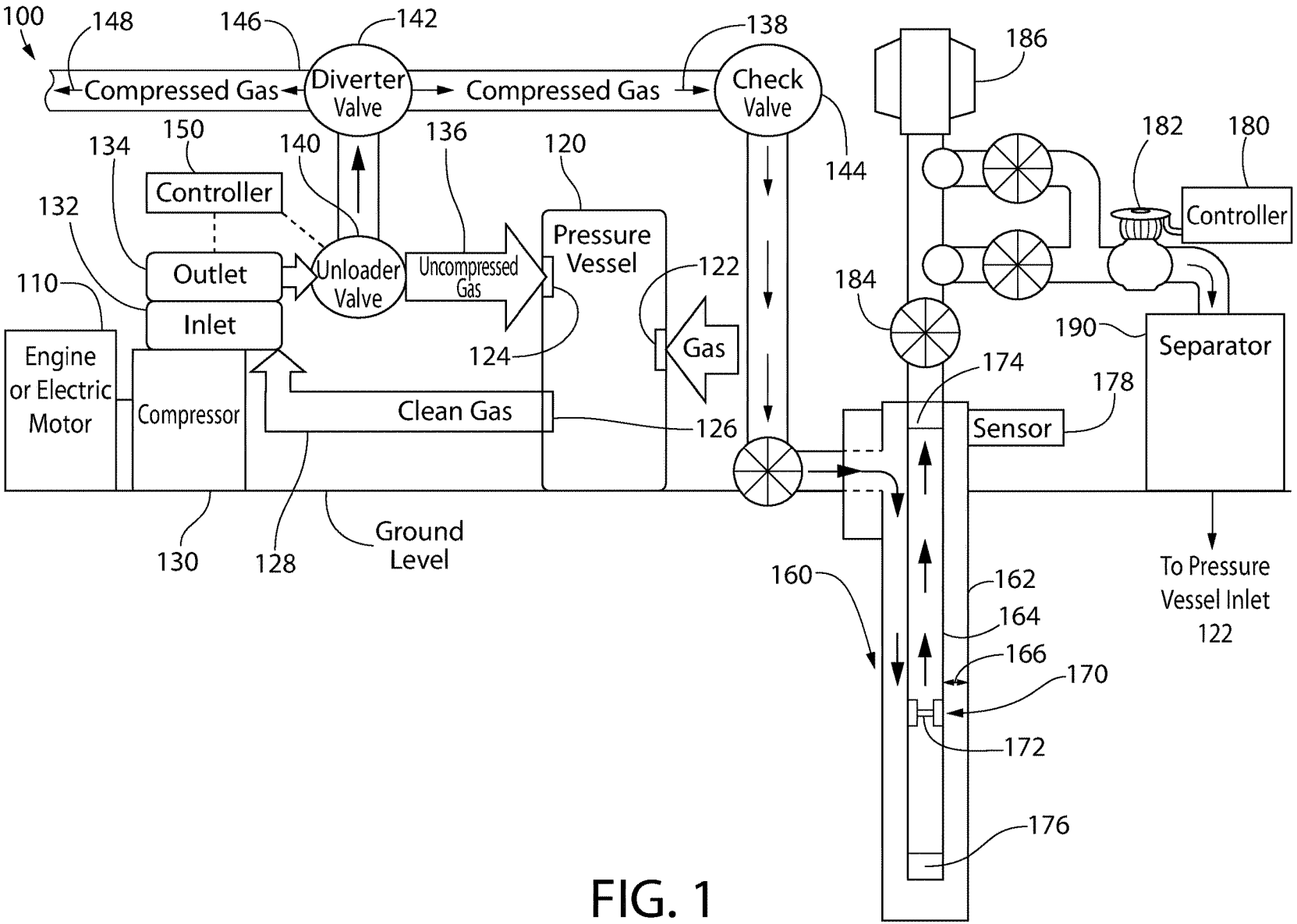
FIG. 1 illustrates a schematic view of a system for operating a gas lift plunger in a well, according to an embodiment.

It should be noted that some details of the figure have been simplified and are drawn to facilitate understanding of the embodiments rather than to maintain strict structural accuracy, detail, and scale.

DETAILED DESCRIPTION

In general, embodiments of the present disclosure may provide a system, and method for operating such system, which may perform dual functions as a line machine and a gas-injection machine. Both functions may be employed, in some embodiments, to assist with lifting a gas-lift plunger in a production tubing in a well. Operating as a line machine, the system may apply a low pressure (suction) to the top of the production tubing, while, operating as an injection machine, the system may feed relatively high pressure gas into an annulus, and back up through the production tubing. To provide such dual functionality, the system may employ an unloader valve, which may, in response to signals from one or more controllers, pressure transducers, etc., route uncompressed gas to a pressure vessel, while allowing the compressor to continue operating. The system may also include a diverter valve, which may route selectively route gas to a sales line or to the well annulus, to perform the lifting operation. Additional details related to the specific embodiments, potentially including several option features, are described below.

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a schematic view of a system 100 for operating a gas lift plunger 170 in a well 160, according to an embodiment. The system 100 may include a driver 110, such as an internal combustion engine or electric motor, a pressure vessel 120, and a compressor 130. When active, the driver 110 drives the compressor 130, such that the compressor 130 is capable of compressing gas.

The pressure vessel 120 may be a separator (e.g., a scrubber). The pressure vessel 120 may have one or more inlets (two are shown: 122, 124) and one or more outlets (one is shown: 126). The pressure vessel 120 may be configured to receive a gas through the first inlet 122, the second inlet 124, or both inlets 122, 124. Although not shown, in at least one embodiment, the pressure vessel 120 may include a single inlet, and the two inlet flows may both enter the pressure vessel 120 through the single inlet (e.g., via a T-coupling coupled to the single inlet). The pressure vessel 120 may then separate (i.e., remove) particles from the gas to clean the gas. In at least one embodiment, the pressure vessel 120 may be a gravity-based separator, such that the separation may be passive, allowing the denser solid particles to fall to the bottom of the pressure vessel 120. The clean gas may then exit the pressure vessel 120 through the outlet 126. The pressure vessel 120 may have an internal volume ranging from about 0.04 $m^3$ to about 0.56 $m^3$, or more.

The compressor 130 may include an inlet 132 that is coupled to and in fluid communication with the outlet 126 of the pressure vessel 120. The gas that flows out of the outlet 126 of the pressure vessel 120 may be introduced into the inlet 132 of the compressor 130, as shown by arrows 128. The compressor 130 may be configured to compress the gas received through the inlet 132. The gas may exit the compressor 130 through an outlet 134 of the compressor 130. The compressor 130 may be a reciprocating compressor. In other embodiments, the compressor 130 may be a centrifugal compressor, a diagonal or mixed-flow compressor, an axial-flow compressor, a rotary screw compressor, a rotary vane compressor, a scroll compressor, or the like.

A first valve (also referred to as an "unloader valve") 140 may be coupled to and in fluid communication with the outlet 134 of the compressor 130. When the first valve 140 is in a first position, the gas may flow through the first valve 140 and be introduced back into the pressure vessel 120, as shown by arrows 136. For example, the gas may be introduced into the pressure vessel 120 through the second inlet 124. When the first valve 140 is in a second position, the gas exiting the compressor 130 may flow through the first valve 140 and be introduced into a well 160 (as shown by arrows 138) and/or a sales line 146 (as shown by arrows 148). As used herein, a "sales line" refers to a pipeline where the gas is metered and sold.

A second valve (also referred to as a "diverter valve") 142 may be coupled to and in fluid communication with the outlet 134 of the compressor 130 and/or the first valve 140. As shown, the second valve 142 may be positioned downstream from the first valve 140. When the second valve 142 is in a first position (e.g., "open"), the gas from the compressor 130 may flow through the second valve 142 and be introduced into the sales line 146, as shown by arrows 148. The gas may not flow into the well 160 when the second valve 142 is in the first position. When the second valve 142 is in a second position (e.g., "shut"), the gas from the compressor 130 may flow through the second valve 142 and be introduced into the well 160, as shown by arrows 138. The gas may not flow into the sales line 146 when the second valve 142 is in the second position.

A third or "secondary" valve 144 may be coupled to and in fluid communication with the second valve 142. The third valve 144 may be positioned between the second valve 142 and the well 160 (i.e., downstream from the second valve 142). The third valve 144 may be a check valve that allows the gas to flow through in one direction but not in the opposing direction. For example, the third valve 144 may allow the gas to flow from the compressor 130 into the well 160, but not from the well 160 into the sales line 146. Optionally, another check valve may be positioned between the first valve 140 and the second valve 142, so as to prevent backflow of gas into the first valve 140.

A first controller 150 may be coupled to the compressor 130, the first valve 140, the second valve 142, or a combination thereof. As discussed in greater detail below, the first controller 150 may be configured to actuate the first valve 140 between its first and second positions. The first controller 150 may also be configured to actuate the second valve 142 between its first and second positions. In addition, the first controller 150 may be configured to cause the compressor 130 to not compress the gas during predetermined intervals. In other words, the gas flowing out through the outlet 134 of the compressor 130 may have substantially the same pressure as the gas flowing in through the inlet 132 of the compressor 130 during such intervals. In one embodiment, the compressor 130 may not compress the gas when the first valve 140 is in the first position, and the compressor 130 may compress the gas when the first valve 140 is in the second position.

Referring back to the well 160, a casing 162 may be coupled to the wall of the well 160 by a layer of cement. A tubing string (e.g., a production string) 164 may be positioned radially-inward from the casing 162. An annulus 166 may be defined between the casing 162 and the tubing string 164. A plunger 170 may be moveable within the tubing string 164. In some embodiments, a substantially fluid-tight seal may be formed between the outer surface of the plunger 170 and the inner surface of the tubing string 164. Optionally, a bore may be formed axially-through the plunger 170, and a valve 172 may be positioned within the bore. The valve 172 may be opened when the plunger 170 contacts a first actuator (e.g., "bumper spring") 174 proximate to the upper end of the tubing string 164. The valve 172 may be closed when the plunger 170 contacts a second actuator (e.g., "bumper spring") 176 proximate to the lower end of the tubing string 164. In another embodiment, the plunger 170 may be a pad-type plunger.

The plunger 170 may cycle from the bottom of the well 160, to the top of the well 160, back to the bottom of the well 160, and so on. More particularly, when the valve 172 in the plunger 170 is in the closed position and the well 160 is producing enough gas to lift the liquid, the gas may lift the plunger 170, and the liquid that is above the plunger 170 in the tubing string 164, to the surface (e.g., when an outlet valve is opened at the surface). As discussed in more detail below, when the well 160 is not producing enough gas to lift the liquid to the surface, or the well 160 is not producing enough gas to lift the liquid to the surface within a predetermined amount of time, additional compressed gas (e.g., from the compressor 130) may be introduced into the well 160 to lift the plunger 170 and the liquid. When the plunger 170 reaches the surface and contacts the first actuator 174, the valve 172 in the plunger 170 may open, which may allow the plunger 170 to descend toward the bottom of the well 160.

When the plunger 170 reaches the bottom of the well 160 and contacts the second actuator 176, the valve 172 in the plunger 170 may close. Then, the gas produced in the well 160, the compressed gas introduced into the well 160, or a combination thereof may lift the plunger 170, and the liquid that is above the plunger 170 in the tubing string 164, back to the surface. The plunger 170 may continue to cycle up and down, lifting liquid to the surface with each trip.

The system 100 may also include a sensor 178 positioned proximate to the top of the well 160 (e.g., at or near the surface). The sensor 178 may be coupled to the tubing string 164, the first actuator 174, a lubricator 186 (introduced below), or other equipment at the surface. The sensor 178 may detect or sense each time the plunger 170 reaches the surface. In one embodiment, the sensor 178 may detect or sense when the plunger 170 is within a predetermined distance from the sensor 178. In another embodiment, the sensor 178 may detect or sense when the plunger 170 contacts the first actuator 174 and/or the lubricator 186.

In yet another embodiment, the sensor 178 may be a pressure transducer that is coupled to and/or in fluid communication with the tubing string 164, the first actuator 174, the lubricator 186, the inlet 132 of the compressor 130, the outlet 134 of the compressor 130, or the like. It may be determined that the plunger 170 is at a predetermined position in the well 160 when the pressure measured by the pressure transducer is greater than or less than a predetermined amount. For example, a user may open or close a valve (e.g., valve 182, 184) to cause the plunger 170 to ascend or descend within the well 160. The opening or closing of the valve (e.g., 182, 184) may cause the pressure to increase or decrease beyond the predetermined amount, which may be detected by the sensor 178.

In some embodiments, the system 100 may also include a second controller 180. The second controller 180 may receive the data from the sensor 178 and communicate with the first controller 150 in response to the data from the sensor 178, as discussed in greater detail below. The system 100 may also include a control valve 182 and a master valve 184. The second controller 180 may close and open the control valve 182 depending on the point in the cycle to shut-in the well 160 or allow the well 160 to produce. The lubricator 186 may be positioned above the master valve 184. The lubricator 186 houses a shift rod and shock absorber to actuate the plunger 170 at the surface. Although shown as different components, in another embodiment, the first actuator 174 and the lubricator 186 may be the same component.

In some embodiments, the system 100 may also include a separator 190. The separator 190 may be configured to receive gas from the well 160. The separator 190 may separate (i.e., remove) particles from the gas to clean the gas. In at least one embodiment, the separator 190 may be a gravity-based separator, such that the separation may be passive, allowing the denser solid particles to fall to the bottom of the separator 190. The outlet of the separator 190 may be in fluid communication with the inlet 122 of the pressure vessel 120 and/or the inlet 132 of the compressor 130.

Figure 2:
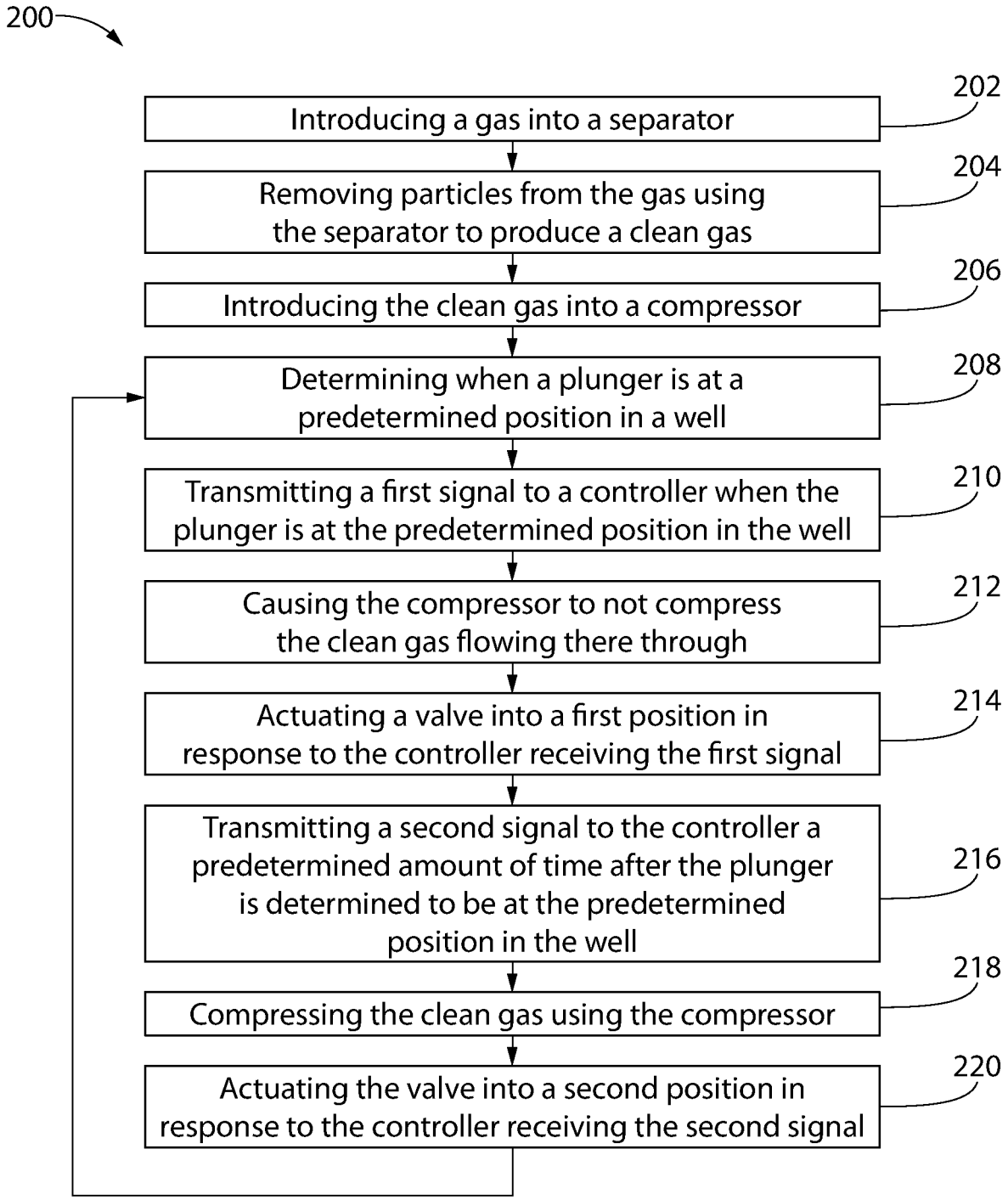
FIG. 2 illustrates a flowchart of a method for operating the gas lift plunger in the well, according to an embodiment.

FIG. 2 illustrates a flowchart of a method 200 for operating the gas lift plunger 170 in the well 160, according to an embodiment. The method 200 is described herein with reference to the system 100 in FIG. 1 as a matter of convenience, but may be employed with other systems. The method 200 may begin by introducing a gas into the pressure vessel 120, as at 202. The gas may be any mixture of natural gases. As described above, the gas may be introduced into the pressure vessel 120 through the first inlet 122 of the pressure vessel 120. The method 200 may then include removing particles from the gas using the pressure vessel 120 to produce a clean gas, as at 204. The method 200 may then include introducing the clean gas into the compressor 130, as at 206.

The method 200 may also include determining, using the sensor 178, when the plunger 170 is at a predetermined position in the well 160, as at 208. In one embodiment, the predetermined position may be proximate to the top of the well 160. In another embodiment, the predetermined position may be when the plunger 170 contacts the first actuator 174 and/or the lubricator 186.

The sensor 178 may transmit a signal to the second controller 180 each time the sensor 178 detects the plunger 170. The method 200 may include transmitting a first signal from the second controller 180 to the first controller 150 when the plunger 170 is at the predetermined position, as at 210. The first signal may be transmitted through a cable or wire, or the first signal may be transmitted wirelessly. In the embodiment where the sensor 178 is a pressure transducer, the second controller 180 may be omitted, and the sensor 178 may send a signal directly to the first controller 150 when the measured pressure is greater than or less than the predetermined amount.

In response to receiving the first signal from the second controller 180 (or the signal from the sensor 178), the first controller 150 may cause the compressor 130 to not compress the gas flowing therethrough (i.e., "unload" the compressor 130 to provide an uncompressed gas), as at 212. In some embodiments, the uncompressed gas may still have a pressure greater than atmospheric pressure. The uncompressed gas may, however, have a lower pressure than the compressed gas (e.g., at 218 below). In response to receiving the first signal, the first controller 150 may also actuate the first valve 140 at the outlet 134 of the compressor 130 into the first position, as at 214, such that the uncompressed gas that exits the compressor 130 flows back into the pressure vessel 120.

When the first valve 140 at the outlet 134 of the compressor 130 is in the first position and the valve 172 in the plunger 170 is open (e.g., after contacting the first actuator 174), the plunger 170 may begin descending back to the bottom of the well 160. The uncompressed gas may continue to flow into the pressure vessel 120 as the plunger 170 descends. The uncompressed gas may only flow into the pressure vessel 120 up to the set suction pressure. The set suction pressure may be from about 15 psi to about 100 psi or more. The pressure vessel 120 may be certified for pressures ranging from about 100 psi to about 400 psi, about 400 psi to about 800 psi, about 800 psi to about 1200 psi, or more. The volume of the pressure vessel 120 (provided above) may be large enough to store the gas introduced from the compressor 130 while the plunger 170 descends in the well 160.

The method 200 may also include transmitting a second signal from the second controller 180 to the first controller 150 a predetermined amount of time after the plunger 170 is determined to be at the predetermined position in the well 160, as at 216. The second signal may be transmitted through a cable or wire, or the second signal may be transmitted wirelessly. In another embodiment, the first controller 150 may have a timer set to the predetermined amount of time so that the second signal from the second controller 180 may be omitted. The predetermined amount of time may be the time (or slightly more than the amount of time) that it takes for the plunger 170 to descend back to the bottom of the well 160 (e.g., to contact the second actuator 176), which may be known or estimated. For example, the density of the plunger 170, the density of the fluids in the well 160, and the distance between the first and second actuators 174, 176 may all be known or estimated. This may enable a user to calculate or estimate the time for the plunger 170 to descend to the bottom of the well 160.

In response to receiving the second signal, the first controller 150 may cause the compressor 130 to compress the clean gas from the pressure vessel 120 to provide a compressed gas, as at 218. In response to receiving the second signal, the first controller 150 may also actuate the first valve 140 at the outlet 134 of the compressor 130 into the second position, as at 220, such that the compressed gas that exits the compressor 130 flows into the well 160, as shown by arrows 138 in FIG. 1. In another embodiment, the first controller 150 may automatically perform steps 218 and 220 after the predetermined amount of time, and the second signal may be omitted.

When the first valve 140 is in the second position, the compressed gas may flow from the compressor 130, through the first valve 140, and into the annulus 166 in the well 160. The compressed gas may then flow down through the annulus 166 and into the tubing string 164 at a position below the plunger 170 and/or the second actuator 176. The compressed gas may then flow up through the tubing string 164, which may lift the plunger 170 back toward the surface. The method 200 may then loop back around to step 208. In another embodiment, an injection valve may be attached to the tubing string 164 at a location below the plunger 170 and/or the second actuator 176. The compressed gas may be injected through the injection valve and into the tubing string 164.

In yet another embodiment, the compressor 130 may pull (e.g., suck) on the tubing string 164. More particularly, gas at the upper end of the tubing string 164 may be introduced into the inlet 132 of the compressor 130. This may exert a force inside the tubing string 164 that pulls the plunger 170 upward. The outlet 134 of the compressor 130 may introduce the compressed gas into the annulus 166, as described above, or a portion of the compressed gas may be introduced into a sales line.

As will be appreciated, the system 100 and method 200 may control the injection of gas from the compressor 130 on demand by "unloading" the compressor 130 (e.g., as at 212 and/or 214) and "loading" the compressor 130 (e.g., as at 218 and/or 220) in response to the detection by the sensor 178, the predetermined amount of time, or a combination thereof. The system 100 and method 200 may also stop the compressor 130 before the compressor 130 runs out of sufficient gas to restart. By redirecting the gas to the pressure vessel 120 (i.e., unloading the compressor 130), the compressor 130 may avoid blowing down and/or emitting gas to the atmosphere. This is accomplished by unloading the compressor 130 back into the pressure vessel 120 and unloading the compressor 130 so that it may restart without any emission of gas to the atmosphere. In addition, by introducing the gas from the compressor 130 back into the pressure vessel 120, rather than releasing the gas into the atmosphere, the loud noise generated by the release of the compressed gas may be avoided. The environmental concerns caused by releasing the compressed gas into the atmosphere may also be alleviated.

Figure 3:
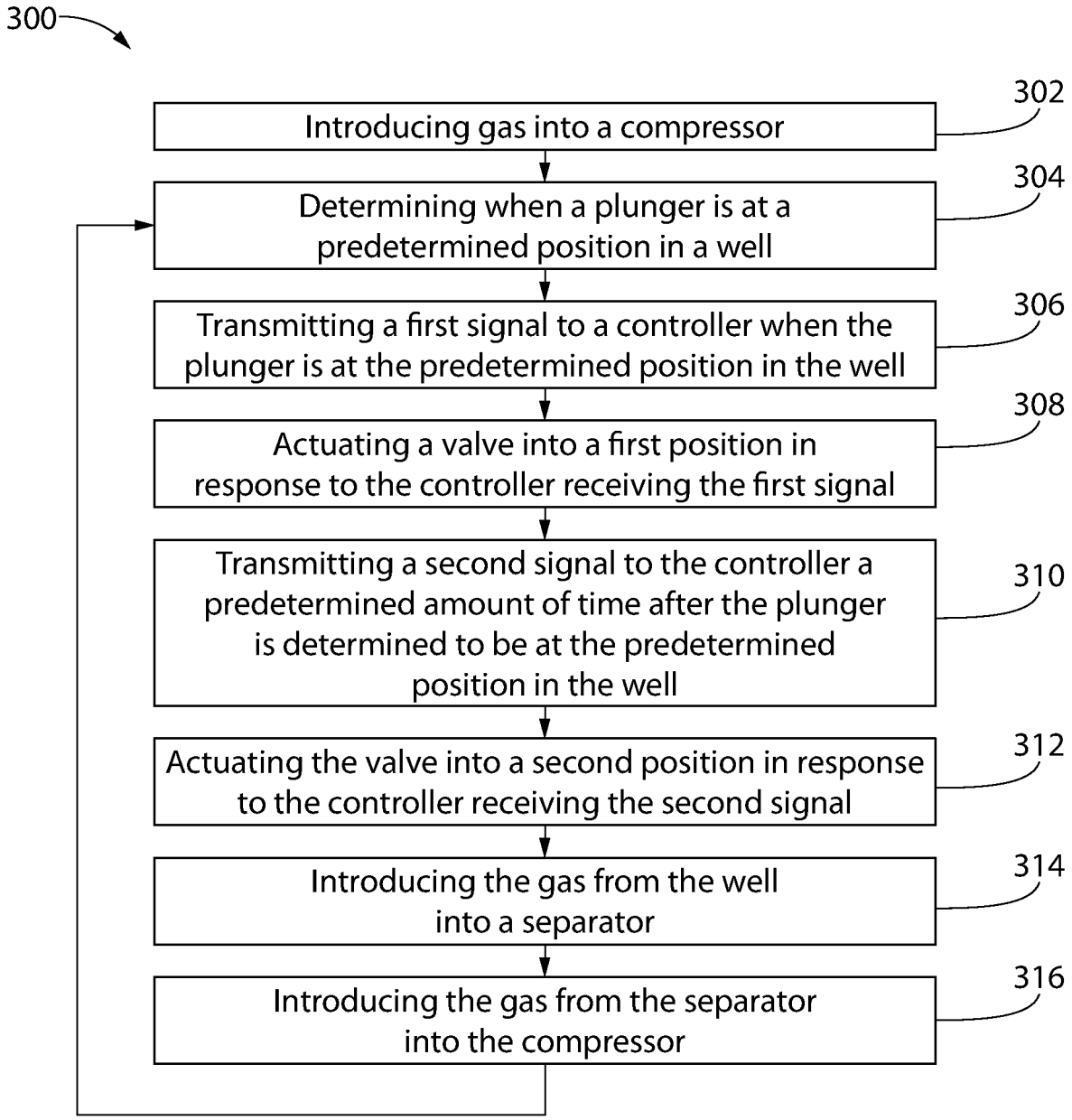
FIG. 3 illustrates a flowchart of another method for operating the gas lift plunger in the well, according to an embodiment.

FIG. 3 illustrates a flowchart of another method 300 for operating the gas lift plunger 170 in the well 160, according to an embodiment. The method 300 is described herein with reference to the system 100 in FIG. 1 as a matter of convenience, but may be employed with other systems. The method 300 may begin by introducing a gas into the compressor 130, as at 302. The gas may come from the pressure vessel 120 or the separator 190 (see FIG. 1).

The method 300 may also include determining, using the sensor 178, when the plunger 170 is at a predetermined position in the well 160, as at 304. In one embodiment, the predetermined position may be proximate to the top of the well 160. In another embodiment, the predetermined position may be when the plunger 170 contacts the first actuator 174 and/or the lubricator 186, after which time, the valve 172 is open, and the plunger 170 begins descending.

The sensor 178 may transmit a signal to the second controller 180 each time the sensor 178 detects the plunger 170. The method 300 may include transmitting a first signal from the second controller 180 to the first controller 150 when the plunger 170 is at the predetermined position, as at 306. The first signal may be transmitted through a cable or wire, or the first signal may be transmitted wirelessly. In the embodiment where the sensor 178 is a pressure transducer, the second controller 180 may be omitted, and the sensor 178 may send a signal directly to the first controller 150 when the measured pressure is greater than or less than the predetermined amount.

In response to receiving the first signal from the second controller 180 (or the signal from the sensor 178), the first controller 150 may actuate the second valve 142 into (or maintain the second valve 142 in) the first position, as at 308. When in the first position, the gas from the compressor is directed into the sales line 146. The third valve 144 prevents the gas in the well 160 from flowing into the sales line 146.

When the second valve 142 is in the first position and the valve 172 in the plunger 170 is open (e.g., after contacting the first actuator 174 and/or the lubricator 186), the plunger 170 may begin descending back to the bottom of the well 160. The compressed gas may continue to flow into the sales line 146 as the plunger 170 descends.

The method 300 may also include transmitting a second signal from the second controller 180 to the first controller 150 a predetermined amount of time after the plunger 170 is determined to be at the predetermined position in the well 160, as at 310. The second signal may be transmitted through a cable or wire, or the second signal may be transmitted wirelessly. In another embodiment, the first controller 150 may have a timer set to the predetermined amount of time so that the second signal from the second controller 180 may be omitted. The predetermined amount of time may be the time (or slightly more than the amount of time) that it takes for the plunger 170 to descend back to the bottom of the well 160 (e.g., to contact the second actuator 176), which may be known or estimated. For example, the density of the plunger 170, the density of the fluids in the well 160, and the distance between the first and second actuators 174, 176 may all be known or estimated. This may enable a user to calculate or estimate the time for the plunger 170 to descend to the bottom of the well 160.

In response to receiving the second signal, the first controller 150 may actuate the second valve 140 into the second position, as at 312. In another embodiment, the first controller 150 may automatically perform the actuation at 312 after the predetermined amount of time, and the second signal may be omitted.

When the second valve 142 is in the second position, the compressed gas may flow from the compressor 130, through the second valve 142, and into the annulus 166 in the well 160. A pressure of the gas flowing into the well 160 may be substantially equal to a pressure of the gas introduced into the sales line 146. The compressed gas may then flow down through the annulus 166 and into the tubing string 164 at a position below the plunger 170 and/or the second actuator 176. The compressed gas may then flow up through the tubing string 164, which may lift the plunger 170 back toward the surface. In another embodiment, an injection valve may be attached to the tubing string 164 at a location below the plunger 170 and/or the second actuator 176. The compressed gas may be injected through the injection valve and into the tubing string 164.

The compressed gas and/or the gas lifted by the plunger 170 may then flow through the valves 182, 184 and into the separator 190, as at 314. The gas may then exit the separator and flow back into the inlet 132 of the compressor 130, as at 316, to complete the loop. When the gas flowing out of the well 160 is introduced back into the compressor (via the separator 190), this allows the compressor to pull (e.g., suck) on the tubing string 164. This may exert a force inside the tubing string 164 that pulls the plunger 170 upward.

The plunger 170 may continue to ascend in the well 160 during 314, 316, or both. The method 300 may then cycle back to determining when the plunger 170 is at a predetermined position in the well 160, as at 304.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for operating a gas lift plunger in a well, comprising:

determining that the plunger is at a predetermined position in the well;

actuating an unloader valve into a first position to introduce gas from a compressor into a pressure vessel;

actuating the unloader valve into a second position and a diverter valve into a first position to introduce the gas from the compressor into a sales line in response to determining that the plunger is at the predetermined position in the well;

actuating the unloader valve into the second position and the diverter valve into a second position to introduce the gas from the compressor into the well at a predetermined amount of time after the plunger is determined to be at the predetermined position in the well;

introducing the gas, that was introduced into the well, into a separator, wherein the separator comprises a gravity-based separator;

introducing the gas, that was introduced into the separator, into the pressure vessel, wherein the pressure vessel comprises a scrubber; and introducing the gas, that was introduced into the pressure vessel, into the compressor, wherein the compressor is configured to unload by introducing the gas from the compressor back into the pressure vessel at a lesser pressure than when the gas is introduced from the compressor into the sales line, the well, or both.

2. The method of claim 1, wherein the predetermined position is proximate to a top of the well.

3. The method of claim 1, wherein the predetermined position is proximate to an actuator, and wherein the actuator is configured to open a valve in the plunger.

4. The method of claim 1, wherein a pressure of the gas introduced into the sales line is substantially equal to a pressure of the gas introduced into the well.

5. The method of claim 1, wherein the gas is introduced into the sales line as the plunger descends in the well.

6. The method of claim 1, wherein the predetermined amount of time is equal to or greater than an amount of time for the plunger to descend to an actuator at a bottom of the well.

7. The method of claim 1, wherein the gas introduced into the well is used to lift the plunger in the well.

8. The method of claim 1, further comprising introducing the gas, that was introduced into the well, into an inlet of the compressor to lift the plunger within the well.

9. The method of claim 1, wherein the plunger is determined to be at the predetermined position in the well when a pressure is greater than or less than a predetermined amount.

10. The method of claim 1, wherein the diverter valve causes the compressor to cycle between introducing the gas into the sales line and introducing the gas into the well without releasing the gas into the atmosphere.

11. The method of claim 1, wherein the compressor pulls the plunger upward as the plunger ascends in the well.

12. The method of claim 1, wherein the compressor is configured to unload by introducing the gas from the compressor back into the pressure vessel at a pressure that is greater than atmospheric pressure without emitting the gas to the atmosphere.

13. A method for operating a gas lift plunger in a well, comprising:

determining that the plunger is at a predetermined position in the well, wherein the predetermined position is proximate to a top of the well;

actuating an unloader valve into a first position to introduce gas from a compressor into a pressure vessel;

actuating the unloader valve into a second position and a diverter valve into a first position to introduce the gas from the compressor into a sales line in response to determining that the plunger is at the predetermined position in the well;

actuating the unloader valve into the second position and the diverter valve into a second position to introduce the gas from the compressor into the well at a predetermined amount of time after the plunger is determined to be at the predetermined position in the well, wherein the predetermined amount of time is equal to or greater than an amount of time for the plunger to descend to an actuator at a bottom of the well, wherein the gas introduced into the well is used to lift the plunger in the well, and wherein a pressure of the gas introduced into the sales line is substantially the same as a pressure of the gas introduced into the well;

introducing the gas, that was introduced into the well, into a separator, wherein the separator comprises a gravity-based separator;

introducing the gas, that was introduced into the separator, into the pressure vessel, wherein the pressure vessel comprises a scrubber; and introducing the gas, that was introduced into the pressure vessel, into the compressor, wherein the compressor is configured to unload by introducing the gas from the compressor back into the pressure vessel at a lesser pressure than when the gas is introduced from the compressor into the sales line, the well, or both.

14. The method of claim 13, further comprising introducing the gas, that was introduced into the well, into an inlet of the compressor to lift the plunger within the well.

15. A system for operating a gas lift plunger in a well, comprising:

a sensor configured to determine that the plunger is at a predetermined position in the well;

a pressure vessel configured to store a gas, wherein the pressure vessel comprises a scrubber;

a compressor configured to receive the gas from the pressure vessel and to output the gas;

an unloader valve configured to introduce the gas output from the compressor back into the pressure vessel when in a first position;

a diverter valve configured to receive the gas from the compressor when the unloader valve is in a second position, wherein the diverter valve is configured to direct the gas output from the compressor into a sales line in response to the sensor determining that the plunger is at the predetermined position in the well and to direct the gas output from the compressor into the well at a predetermined amount of time after the plunger is determined to be at the predetermined position in the well, and wherein the compressor is configured to unload by introducing the gas from the compressor back into the pressure vessel at a lesser pressure than when the gas is introduced from the compressor into the sales line, the well, or both; and a separator configured to receive the gas that was directed into the well, wherein the separator comprises a gravity-based separator, wherein the gas that is received in the separator is configured to be introduced into the pressure vessel.

16. The system of claim 15, further comprising a check valve in fluid communication with the diverter valve, wherein the check valve prevents the gas in the well from flowing into the sales line.

17. The system of claim 16, wherein the check valve is positioned between the diverter valve and the well.

18. The system of claim 15, wherein the sensor comprises a pressure transducer.

19. The system of claim 15, wherein the sensor is positioned proximate to an actuator in the well, and wherein the plunger descends in the well after the plunger contacts the actuator.

20. The system of claim 15, further comprising:

a compressor controller configured to receive the position of the plunger from the sensor; and a second controller configured to actuate the diverter valve, wherein the compressor controller is configured to communicate with the second controller.

* * * * *